United States Patent [19]

Murakami

[11] 4,456,384

[45] Jun. 26, 1984

[54] TOY ROBOT HAVING TIMEPIECE ON TORSO THEREOF

[75] Inventor: Katsushi Murakami, Tokyo, Japan

[73] Assignee: Kabushiki Kaisha Bandai, Tokyo, Japan

[21] Appl. No.: 478,453

[22] Filed: Mar. 24, 1983

[30] Foreign Application Priority Data

| | | | |
|---|---|---|---|
| Mar. 29, 1982 | [JP] | Japan | 57-50673 |
| Apr. 27, 1982 | [JP] | Japan | 57-70854 |
| Jan. 19, 1983 | [JP] | Japan | 58-6910 |
| Jan. 24, 1983 | [JP] | Japan | 58-9696 |

[51] Int. Cl.[3] ..... G04B 47/00; A63H 3/00

[52] U.S. Cl. ..... 368/10; 446/73

[58] Field of Search ..... 46/161, 153; 368/10

[56] References Cited

U.S. PATENT DOCUMENTS 4,411,097 10/1983 Murakami ..... 46/161

*Primary Examiner*—Bernard Roskoski

*Attorney, Agent, or Firm*—R. Gale Rhodes, Jr.

[57] ABSTRACT

A toy robot equipped with a timepiece is provided which can be used as a plaything as well as a table clock. The toy robot comprises a robot body portion, a timepiece, and arm and leg assemblies. The robot body portion simulates a torso of the toy robot and has front and rear hollow body sections divided by a partition plate. The timepiece is fixedly mounted on the partition plate and is accommodated within the hollow of the front body section. The arm and leg assemblies are mounted in the rear hollow body section and are constructed in such a manner that the assemblies can be accommodated within and pulled out of the hollow of the rear body section. A cap member can be provided for journaling to the front body section to cover the surface of the timepiece. The cap member is used as a head of the toy robot when it is lifted up from the timepiece.

5 Claims, 15 Drawing Figures

TOY ROBOT HAVING TIMEPIECE ON TORSO THEREOF

BACKGROUND OF THE INVENTION (a) Field of the Invention

The present invention relates to a toy robot having a timepiece on the torso thereof. More specifically, the present invention pertains to such a toy robot which can be used as a plaything for children as well as a timepiece which may be used either as a table clock or a wrist watch.

(b) Description of the Prior Art

Hitherto fore, many attempts have been made for adding toy like appearances to a table clock or a wrist watch particularly for use by children in order to amuse them. One of such conventional table clocks or wrist watches proposes to have an outer casing resembling a famous television character or the like. In another conventional known table clock or wrist watch, it has been common to have hands of the table clock or wrist watch made in the form of scissors-paper-rock. There are others in which eye-catching pictures or devices are drawn on a dial face or a wrist watch band. The concept is to add a plus something factor to a wrist watch or a table clock in order to draw children's attention.

The thought process for making such a conventional wrist watch or table clock weighs a primary importance on a timepiece function and aims at adding a plus something factor as a secondary thing as mentioned above. In other words, no prior art aims at making a toy wrist watch or a table clock equipped with a watch function as well as a toy function.

SUMMARY OF THE INVENTION

It is, therefore, a principal object of the present invention to provide a novel toy robot having a timepiece on the torso thereof which changes an image of a wrist watch or table clock of those known type.

It is another object of the present invention to provide the novel toy robot with a timepiece on the torso thereof as above, which can be used as a plaything for children as well as a timepiece which may be used either as a table clock or a wrist watch.

In keeping with these objects, and with others which will become apparent hereinafter, one feature of the present invention resides, briefly stated, in that the toy robot having a timepiece on the torso thereof has a wide range of possible postures to enhance its play value, but comprises a relatively small number of components, which is obviously advantageous for production and assembly. The toy robot according to the invention comprises a robot body portion which is mainly divided into two hollow portions by a partition plate. One of the hollow portions is used for mounting a timepiece, and the other is used for accommodating an arm assembly and a leg assembly. The dial face of the timepiece may be covered by a cap, the cap being journaled by a hinge and when opened it is used as a head portion. The arm assembly is journaled for movement into the body hollow portion and for movement out of the body hollow portion. Preferably, a pair of arms are coupled by a spring for enhancing the emerging movement of the assembly out of the body hollow portion. The arm comprises a shoulder member, upper and lower arm members, and a hand member. The former three members are journaled for pivotal movement with respect to each other about respective pins mounted thereon. The pins are formed to provide frictional restraint which helps to maintain the arm assembly in any desired position of adjustment relative to the body. The arm terminates in claw-like hand.

The leg assembly comprises a pair of legs which may be formed as a unitary structure to move in unison or they may be formed separately and move independently of each other. The leg assembly is accommodated within the body hollow portion by pushing it or is pulled out therefrom. Preferably, each leg is provided with a stop control device which can control the leg assembly to stop at the two positions corresponding to the accommodated and pulled out states.

In the most preferred example contemplated of the present invention which will be described hereinunder, the toy robot having a timepiece on the torso thereof comprises:

(a) a robot body portion simulating a torso of the toy robot and having front and rear body sections which are hollow and divided by a partition plate;

(b) a timepiece fixedly mounted on said partition plate and accommodated within the hollow of said front body section;

(c) an arm assembly mounted in said rear body section which can be accommodated within and pulled out of the hollow of said rear body section, said arm assembly comprising a pair of shoulder elements and a pair of arm elements each journaled for frictional pivotal movement around a pin mounted on respective said shoulder elements, said shoulder element being made of a cylindrical hollow member opening at one end surface and closing at the other end surface, said one end surface being provided with a rim extending perpendicularly to the longitudinal axis of said cylindrical hollow member and said the other end surface being mounted with said pin;

(d) a spring mounted within and between said cylindrical hollow to urge said arm assembly to move toward outside said rear body section;

(e) stop means formed within said rear body section in order to prevent said arm assembly from being removed from said rear body section, said stop means engaging with said rim in order to stop said arm assembly;

(f) a leg assembly mounted in said rear body section which can be accommodated within and pulled out of the hollow of said rear body section, said leg assembly comprising a pair of leg elements each having a rectangular cross-section and having retaining means and engaging means formed thereon, said retaining means serving to hold said leg element either one of the positions where said leg element is accommodated position or pulled out position in cooperation with notches formed across the surface of said pertition plate, said engaging means engaging with said rim when said arm assembly is pushed into said front hollow body portion, thereby maintaining said arm assembly in an accommodated state; and (g) a cap member journaled by a hinge mounted on said front body section for covering and uncovering said timepiece, said cap member is simulated to a head of said toy robot, whereby when said cap member is lifted around said hinge, said cap member serves as a head of said toy robot.

The foregoing objects and advantages of the invention as well as the structure characteristic of the invention, and modifications and improvements thereto, become more apparent to the reader from a consideration of the detailed description of the preferred embodiments of the invention which follows, taken together with the illustrations thereof presented in the accompanying figures of the drawings.

DETAILED DESCRIPTION OF THE PREFERRED EMBODIMENTS

Figure 4:
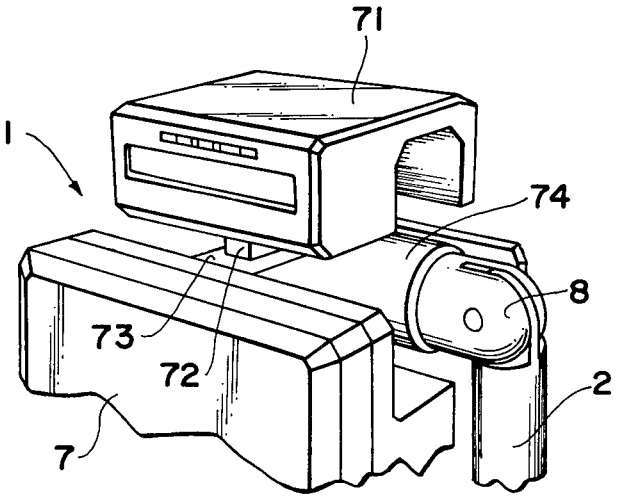
FIG. 4 is an enlarged, partial, top side perspective view of the first embodiment of the toy robot shown in FIG. 1, illustrating the construction of the head member and the arm assembly with respect to the body portion.
Figure 5:
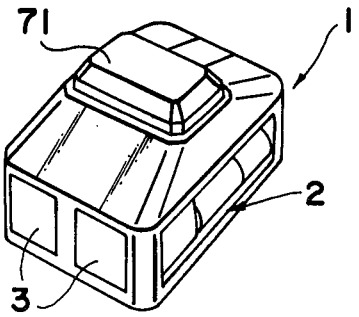
FIG. 5 is a top side perspective view of a second embodiment of the toy robot with a timepiece on the torso thereof according to the invention.
Figure 6:
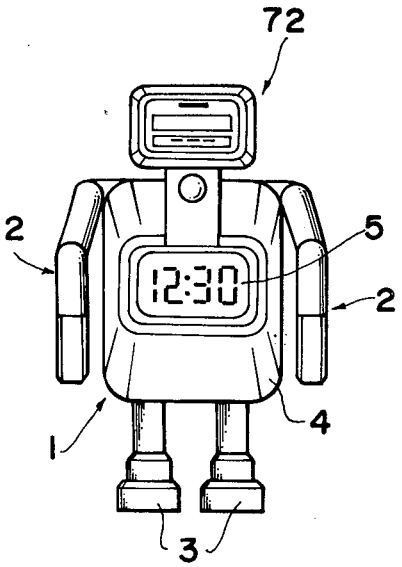
FIG. 6 is a front view of the second embodiment of the toy robot shown in FIG. 5, in which head member, arm and leg assemblies are all pulled out from the body hollow portion of the toy robot.
Figure 7:
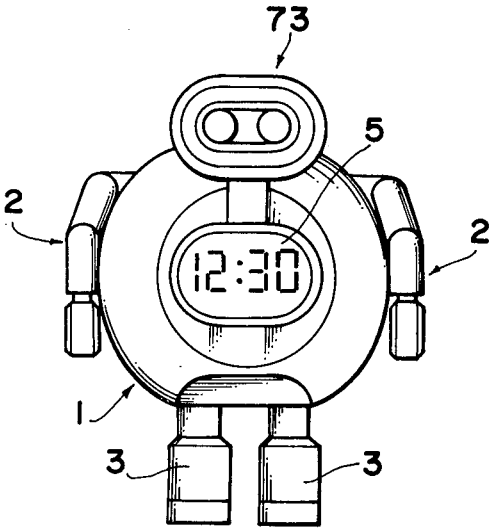
FIG. 7 is a front view of a third embodiment of the toy robot having a timepiece on the torso thereof according to the invention.
Figure 11:
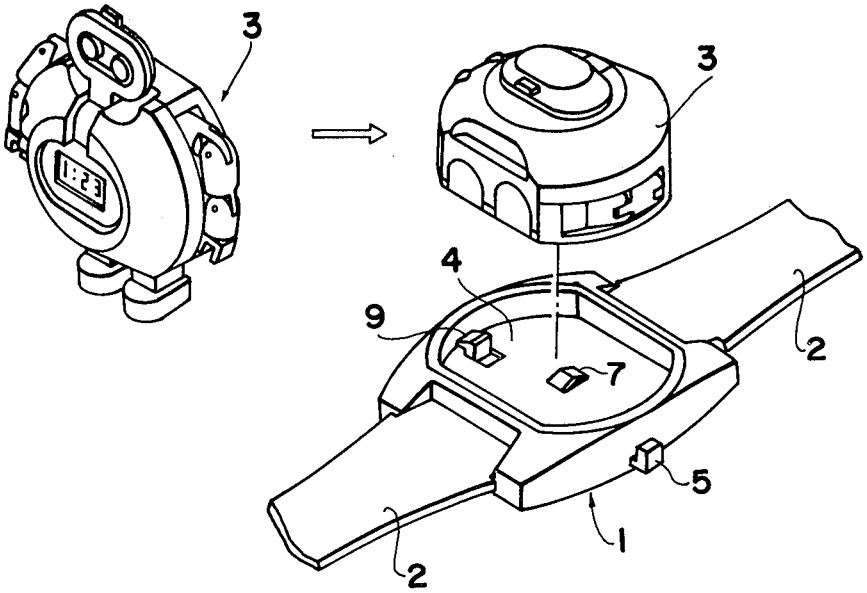
FIG. 11 is a schematic illustration representing an aspect of the toy robot when used as a wrist watch.
Figure 12:
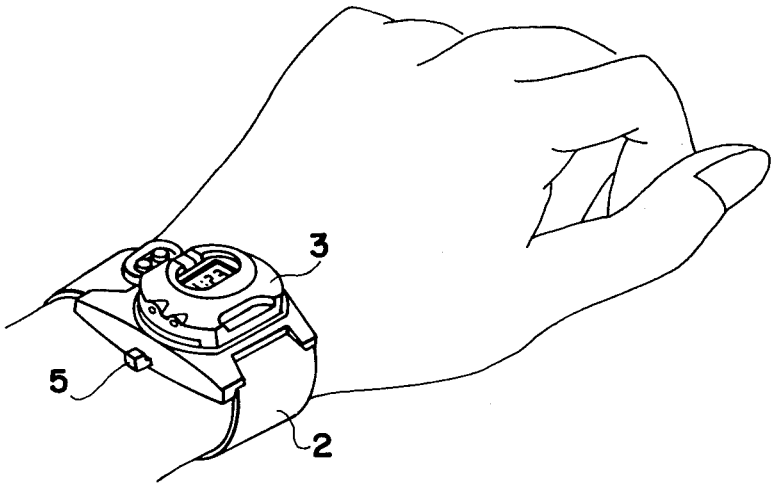
FIG. 12 is a schematic illustration representing the wrist watch shown in FIG. 11 when weared on the wrist.

A toy robot with a timepiece on the torso thereof in accordance with the present invention will now be described hereinuder, in conjunction with the accompanying drawings. In the figures, a first embodiment of the toy robot according to the invention is illustrated in FIGS. 1 to 4, a second embodiment is illustrated in FIGS. 5 and 6, a third embodiment is illustrated in FIG. 7, a fourth embodiment is illustrated in FIGS. 8 to 10, and lastly the application of the toy robot in accordance with the present invention to a wrist watch is schematically illustrated in FIGS. 11 and 12.

Among the four embodiments, the most preferred form of the toy robot is shown in greater detail in the fourth embodiment. Therefore, the description is first begun with FIGS. 8 to 10.

Figure 10:
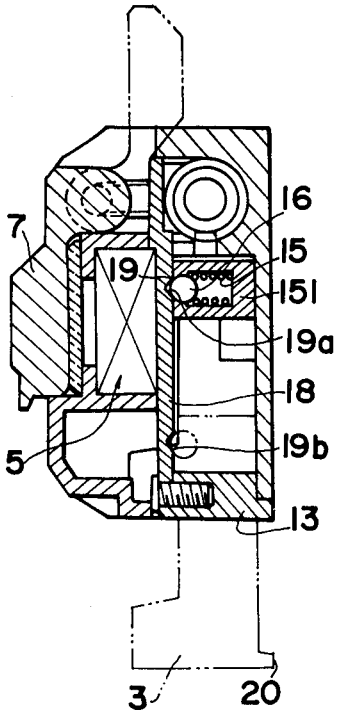
FIG. 10 is a side elevational cross-section of the fourth embodiment of the toy robot shown in FIG. 8.
Figure 8:
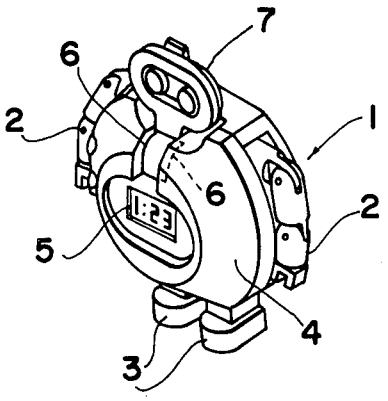
FIG. 8 is a top side perspective view of a fourth embodiment of the toy robot having a timepiece on the torso thereof according to the invention.
Figure 9:
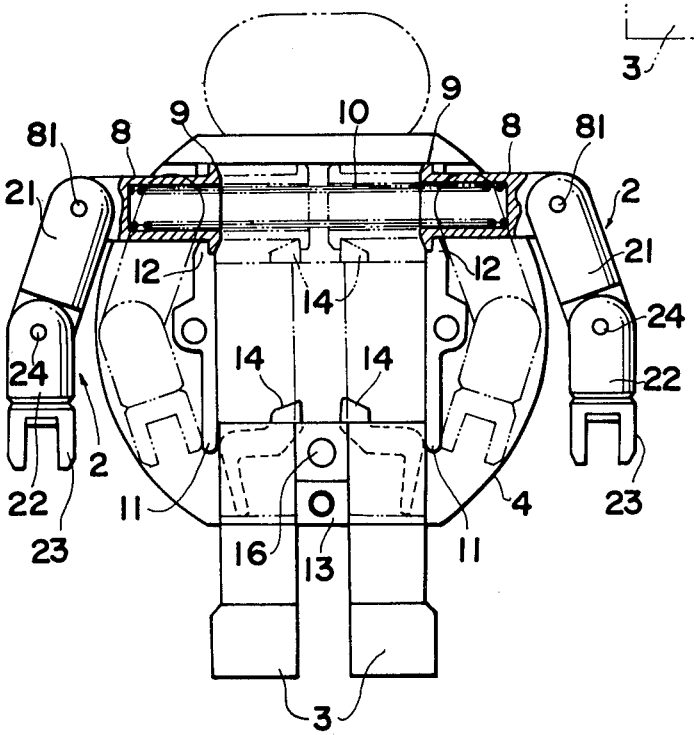
FIG. 9 is a front view of the fourth embodiment of the toy robot shown in FIG. 8, in which some elements are removed away for better illustrating the internal construction of the arm and leg assemblies in their accommodated and pulled out states.

Referring now to FIGS. 8 to 10, a toy robot with a timepiece is designated in its entirety by reference number 1. An arm assembly 2 is mounted in a robot body portion 4 which simulates a torso of the robot 1. A leg assembly 3 is also mounted in a robot body portion 4 at its lower position relative to the arm assembly 2. Both arm and leg assemblies 2 and 3 are constructed as they can be accommodated within and pulled out of the robot body portion as described later in more detail.

The robot body portion 4 comprises front and rear hollow body sections. In the front hollow body section, a timepiece 5 is mounted. The timepiece 5 can be of any conventional type, such as digital clock having a liquid crystal display. The timepiece 5 can be covered by a cap 7 simulating a face and head of the toy robot 1. The cap 7 is journaled for pivotal movement around a hinge 6 mounted on the front hollow body section for covering and uncovering the timepiece 5.

As is best shown in FIGS. 9 and 10, the arm assembly 2 is mounted in the rear hollow body section in such a manner as the arm assembly can be accommodated within and pulled out of the hollow of the rear body section. The arm assembly 2 comprises a pair of shoulder elements 8 and a pair of upper arms 21, a pair of lower arms 22, and a pair of hands 23. The upper arm 21 is journaled for coupling to the shoulder 8 around a pin 81 mounted at one end surface of the shoulder element 8. The pin 81 gives a large frictional contact to the bifurcated portion of the upper arm 21 so that the upper arm 21 can maintain any desired position of adjustment relative to the shoulder element 8. Similarly to the above, the lower arm 22 is journaled for coupling to the upper arm 21 around a pin 24 mounted at one end surface of the upper arm 21 opposite to the bifurcated portion thereof. The pin 24 and the bifurcated portion are coupled with a frictional restraint therebetween so that the lower arm 22 can maintain any desired position of adjustment relative to the upper arm 21. The hand 23 is formed in claw-like shape as shown in FIGS. 8 and 9, and is journaled for rotation around the axis extending to the longitudinal direction of the lower arm 22.

The shoulder element 8 is made of a cylindrical hollow member opening at one end surface and closing at the other end surface. The one end surface is provided with a rim 9 which extends perpendicularly to the longitudinal axis of the cylindrical hollow member. The other end surface is provided with the pin 81 for journaling the upper arm 21. Between the pair of the shoulder elements, a spring is inserted into the hollow of the shoulder elements 8, which spring 10 always exerts a force to move the shoulder elements 8 toward the outside of the rear hollow body section.

In the rear hollow body section, which is separated from the front hollow body section by a partition plate 18, there are provided further a pair of guide plates 11. The guide plate serves to form a guide channel for passing therethrough the leg assembly 3 to be accommodated into and pulled out of the rear hollow body section. The guide plate 11 is formed with a projection 12 which serves as a stop of the arm assembly 2, and the stop member or projection 12 engages with the rim 9 in order not to allow the arm assembly to move excessively toward outside of the rear body section. In this embodiment, a center pole 13 is mounted in the front hollow body section in order to ensure or obtain a fail safe measure for removal of the leg assembly out of the front hollow body section.

The leg assembly 3 comprises a pair of legs which may be formed as a unitary structure to move in unison or they may be formed separately and move independently of each other. In order to simplify the construction of the toy robot, in the preferred embodiment shown in FIGS. 8 to 10, a unitary structure is employed. The leg assembly 3 is made in an inverse U figure to unite a pair of legs, and is guided within the guide path defined by the guide plates 11 and the center pole 13. Each of the legs 3 has a rectangular cross-section and has a retaining device 151 formed at the upper portion thereof. An engaging device 14 of generally L figure shape of resilient synthetic resin, protrudes outwardly of the leg 3 at its top margin. This protruded portion engages with the rim 9 of the shoulder element 9 when the shoulder elements are pushed in order to be accommodated within the rear hollow section, so that the accommodated position is maintained, as shown by a two dotsdash line in FIG. 9. Conversely, when the leg assembly 3 is pulled out of the robot body portion 1, then the engagement is released between the rim 9 and the protruded portion of the projection 12, thereby allowing the arm assembly 2 to emerge out of the robot body 1 with the help of the spring force exerted by the spring 10.

In the upper hollow portion intermediate between the pair of legs 3, there is provided a retaining device 151. The retaining device 151 functions to hold the leg assembly 3 in either of the two positions where the leg assembly 3 is positioned at the accommodated and pulled out conditions. The retaining device 151 comprises a casing, spring and ball. The spring 15 is placed in the casing to push the ball 16 toward the outside of the casing. The ball 16 abuts against the surface of the partition plate 18, where notches **19*a* and 19*b* are cut across the surface. The ball 16 partially falls into the notches so that the position of the leg assembly 3 relative to the robot is readily determined without displacing to the large extent. The two notches 19*a* and 19*b* are formed at the positions corresponding to the leg assembly's two stable positions, that is, an accommodated position and pulled out position. Reference number 20 denotes a heel section which is used, when pulling out the leg assembly 3** out of the robot body, by catching it with a finger.

In operation, when one wishes to use the toy robot with a timepiece as a table clock, the leg assembly 3 is pulled out of the front hollow body section to the position where the ball 16 of the retaining device 151 engages with the under notch **19*b*. Since the engagement between the rim 9 and the protruded portion of the engaging device 14 is released, the arm assembly 2 is caused to move outwardly of the rear hollow body section, thereby exposing the whole upper and lower arms 21 and 22 and hands 23. In this condition, the upper and lower arms 21 and 22 and hands 23 are held in any desired position in which the arms are raised position or lowered position as shown in FIG. 8. The cap 7 is held up to show the display of the timepiece 5**. Apart from the above, when one wishes to use the toy robot with a timepiece as a plaything, then one can enjoy a various figure change of the toy robot due to the provision of the construction which enables the accommodation of the arm and leg assemblies into the body of the toy robot, and the pulling out thereof from the toy robot body. Further, the arm assembly can take any desired positions due to the provision of the frictional contact between the shoulder and upper arm, and between the upper and lower arms.

Referring now back to FIGS. 1 to 4 which illustrate a first embodiment of the toy robot with a timepiece according to the invention, a modification of the toy robot shown in FIGS. 8 to 10 described above is briefly explained. For convenience, the toy robot's main constitutional elements are also employed in the following embodiments. Accordingly, the identifying numbers used in the illustration of FIGS. 8 to 10 to identify the parts of the figure are used in FIGS. 1 to 4 and the succeeding figures.

The difference between the fourth embodiment shown in FIGS. 8 to 10 and this first embodiment resides in that the shape of the robot body portion is changed from generally circular appearance to generally square outer appearance and that the cap 7 covers all the front surface of the robot body of the toy robot 1, and the head portion 71 is additionally provided. The remaining elements such as arm and leg assemblies 2 and 3, and the timepiece 5 are substantially the same as those used in the fourth embodiment. As is best shown in FIG. 4, the independent head portion 71 is so constructed that the neck portion 72 may be inserted into the recess formed in the supporting section 73 mounted in the rear hollow body portion. Thus, the head portion 71 can be accommodated within the front hollow body section and in turn is pulled out of the hollow body section. The shoulder element 8 may be supported within a hollow cylindrical supporting tube 74 which is mounted in the front hollow body section. The figure of the face may be made as desired in any style.

FIGS. 5 and 6 shows another modification of the toy robot in accordance with the present invention. As is apparent from the drawings, this embodiment differs from the preceeding embodiments in that the robot body portion is made of generally rectangular form.

FIG. 7 shows still another modification of the toy robot in accordance with the present invention. This embodiment slightly differs from the embodiment shown in FIGS. 8 to 10 in that the shapes of the leg assembly 3 and the outer peripheral margin of the timepiece 5 are changed.

As appreciated from the foregoing modifications, any change in style, shape and other minor construction may be easily attained without requiring any design change.

In addition to the above aspects of the present invention, the toy robot with a timepiece according the invention may be used as a wrist watch, other than as a table clock and as a plaything as previously described. This is because the toy robot is made fully accommodable of the extremities such as arm, leg, and head, and thus, it is possible to easily support in a wrist watch type container.

Figure 13:
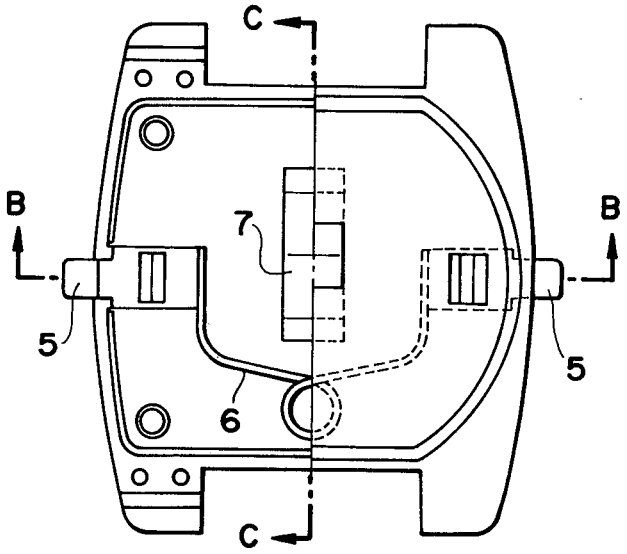
FIG. 13 is a plan view of a case which is used for holding the toy robot as a wrist watch, in which an upper plate of the case is partially broken away to illustrate the interior of the case.
Figure 14:
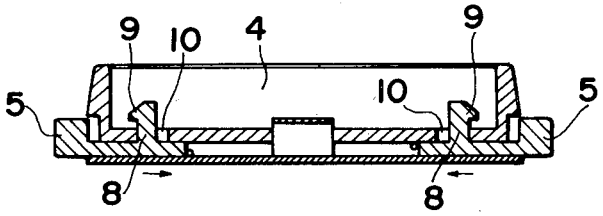
FIG. 14 is a cross-section taken along the lines B—B of FIG. 13.
Figure 15:
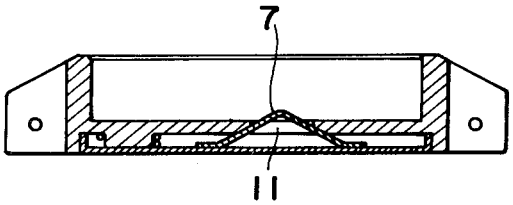
FIG. 15 is a cross-section taken along the lines C—C of FIG. 13.

Referring now first to FIGS. 11 and 12, a brief explanation of a wrist watch is summarised. A tiny toy article, for example, a toy robot as shown in FIG. 11 is accommodated within a container 1 of a wrist watch type figure. The toy robot 3 shown at the left side is changed into a substantially circular shape by folding the arm and leg assemblies and a head portion. The wrist watch type container 1 has strapping bands 2 for wearing on the wrist as shown in FIG. 12. The coupling between the toy robot and the container 1 can be effected exemplarily in a manner hereinafter described. The coupling means applied to the drawing of FIG. 11 is shown in FIGS. 13 to 15. Reference number 4 represents a space within which the toy robot 3 is housed. Reference number 5 designates an operating handle integral with a hook portion 9, the operating handle 5 and the hook portion 9 constitute an engaging device for engaging with a cooperating device formed on the bottom surface of the toy robot. Thus, the coupling therebetween ensures a stable holding of the toy robot 3 within the space 4. Reference numeral 7 designates a plate spring which imparts a force to the bottom surface of the toy robot 3 to help its removal from the space 4 when the operating handle 5 is pushed.

A wrist watch type container will now be explained in detail with reference to FIGS. 13 to 15. In the figures, the wrist bands 2 and hinges around which the bands moves are removed for simplification. A casing member 1 comprises a hollow base portion and an edge portion. The hollow base portion comprises a bottom plate 21, a top plate 22, and a side plate 23. The side plate 23 is made of two flanges extending upwardly of the bottom plate 21 at its peripheral margin and extending downwardly of the top plate 22. And the two flanges superpose with each other. An edge portion 23 is a wall extending upwardly of the top plate 22 at its peripheral margin, which edge portion defines the space 4 within which the toy robot 3 rests. A pair of engaging means are mounted in the space 4 of the hollow base portion. The engaging means 24 comprises a hook portion 9 formed at one end portion and an operating handle 5. The hook portion 9 and the operating portion 5 is integrally formed with each other, the hook portion and the operating portion both extending perpendicularly to the bottom plate surface. The hook portion 9 extends into the space 4 through an opening 10 formed in the top plate 22. The operating handle 5 extends over the outside of the side plate 23 for access by the person handling the container. A spring 6 is coupled between the pair of engaging means 24 for urging both means 24 to move toward the outside, or in other words, to bias toward the outside of the hollow base portion. A plate spring 7 is fixed at opposite ends to the bottom plate 21, the middle part of the plate spring 21 being raised and emerging out of an opening 11 formed on the top plate 22 into the space 4 defined or surrounded by the edge portion 23. Reference number 25 indicates an aperture through which a hinge, not shown, is provided in order to couple the wrist watch band 2.

In the toy robot 3, a pair of openings are formed on the bottom surface of the toy robot 3 for cooperating with the engaging means 24. The opening is provided with a rim which extends outwardly of the margin of the opening, and thus enabling for the hook portion 9 to rest of the inner surface of the rim to retain engagement. The plate spring 7 is adapted to push the bottom surface of the toy robot 3.

Figure 1:
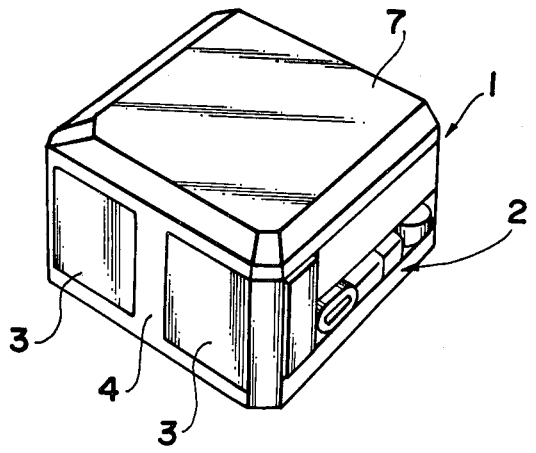
FIG. 1 is a top side perspective view of a first embodiment of the toy robot with a timepiece on the torso thereof according to the present invention.
Figure 2:
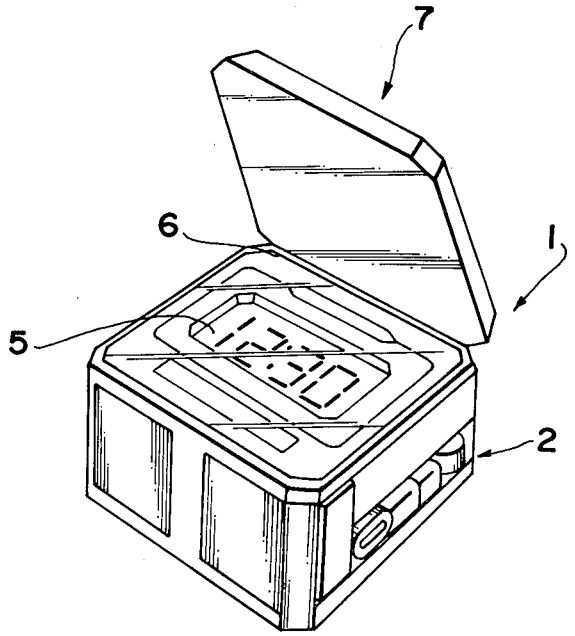
FIG. 2 is a top side perspective view of the first embodiment of the toy robot of FIG. 1, in which a cap for the timepiece is opened to show its dial face.
Figure 3:
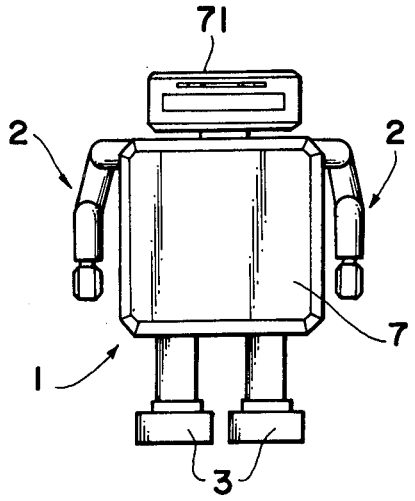
FIG. 3 is a front view of the first embodiment of the toy robot shown in FIG. 1, in which head member, arm and leg assemblies are all pulled out from the body hollow portion of the toy robot.

In operation of the wrist watch type container thus constructed, housing operation of the toy robot 3 into the space 4 is first effected by pushing both operating handles 5 toward the inside of the inner space of the hollow base portion. Thereafter, the toy robot in an accommodated state as shown in FIG. 1 is inserted into the space 4. In this case, the openings of the bottom surface 9 of the toy robot 3 must be correctly mated with the hook portion of the engaging means 24, and the plate spring 7 is also to be pushed by the bottom surface of the robot 3. After checking the position of the hook portion 9 being in the openings and hence inside of the rim, the pushing force applied to the operating handles 5 are released. Then, due to the spring force of the spring 9, the engaging means 24 is moved outwardly from the base hollow portion to obtain a secure engagement between the rim and the hook 9. Conversely to the above, when one wishes to remove the toy robot 3 from the wrist watch type container, it suffices to simply push the operating handles 5 toward the inside of the base hollow portion. This time, the toy robot 3 is pushed by the plate spring 7 and emerges out of the container under the condition that the engagement between the hook portion 9 and the rim is released.

What is claimed is:

1. A toy robot equipped with a timepiece comprising:
(a) a robot body portion simulating a torso of the toy robot and having front and rear body sections which are hollow and divided by a partition plate;
(b) a timepiece fixedly mounted on said partition plate and accommodated within the hollow of said front body section;
(c) an arm assembly mounted in said rear body section which can be accommodated within and pulled out of the hollow of said rear body section; and
(d) a leg assembly mounted in said rear body section which can be accommodated within and pulled out of the hollow of said rear body section.

2. A toy robot equipped with a timepiece as claimed in claim 1, in which said toy robot further comprises a cap member journaled by a hinge mounted on said front body section for covering and uncovering said timepiece.

3. A toy robot equipped with a timepiece as claimed in claim 2, in which said cap member is simulated to a head of said toy robot, whereby when said cap member is lifted around said hinge, said cap member serves as a head of said toy robot.

4. A toy robot equipped with a timepiece comprising:
(a) a robot body portion simulating a torso of the toy robot and having front and rear body sections which are hollow and divided by a partition plate;
(b) a timepiece fixedly mounted on said partition plate and accommodated within the hollow of said front body section;
(c) an arm assembly mounted in said rear body section which can be accommodated within and pulled out of the hollow of said rear body section;
(d) a leg assembly mounted in said rear body section which can be accommodated within and pulled out of the hollow of said rear body section; and
(e) a cap member journaled by a hinge mounted on said front body section for covering and uncovering said timepiece, said cap member is simulated to a head of said toy robot, whereby when said cap member is lifted around said hinge, said cap member serves as a head of said toy robot.

5. A toy robot equipped with a timepiece comprising:
(a) a robot body portion simulating a torso of the toy robot and having front and rear body sections which are hollow and divided by a partition plate;
(b) a timepiece fixedly mounted on said partition plate and accommodated within the hollow of said front body section;
(c) an arm assembly mounted in said rear body section which can be accommodated within and pulled out of the hollow of said rear body section, said arm assembly comprising a pair of shoulder elements and a pair of arm elements each journaled for frictional pivotal movement around a pin mounted on respective said shoulder elements, said shoulder element being made of a cylindrical hollow member opening at one end surface and closing at the other end surface, said one end surface being provided with a rim extending perpendicularly to the longitudinal axis of said cylindrical hollow member and said the other end surface being mounted with said pin;

(d) a spring mounted within and between said cylindrical hollow to urge said arm assembly to move toward outside said rear body section;

(e) stop means formed within said rear body section in order to prevent said arm assembly from being removed from said rear body section, said stop means engaging with said rim in order to stop said arm assembly;

(f) a leg assembly mounted in said rear body section which can be accommodated within and pulled out of the hollow of said rear body section, said leg assembly comprising a pair of leg elements each having a rectangular cross-section and having retaining means and engaging means formed thereon, said retaining means serving to hold said leg element either one of the positions where said leg element is accommodated position or pulled out position in cooperation with notches formed across the surface of said pertition plate, said engaging means engaging with said rim when said arm assembly is pushed into said front hollow body portion, thereby maintaining said arm assembly in an accommodated state; and (g) a cap member journaled by a hinge mounted on said front body section for covering and uncovering said timepiece, said cap member is simulated to a head of said toy robot, whereby when said cap member is lifted around said hinge, said cap member serves as a head of said toy robot.

* * * * *